US006164995A

United States Patent [19]

Peloza

[11] Patent Number: 6,164,995

[45] Date of Patent: Dec. 26, 2000

[54] IMPEDANCE TUNING IN ELECTRICAL SWITCHING CONNECTOR

[75] Inventor: Kirk B. Peloza, Naperville, Ill.

[73] Assignee: Molex Incorporated, Lisle, Ill.

[21] Appl. No.: 09/264,947

[22] Filed: Mar. 9, 1999

[51] Int. Cl.[7] ..... H01R 29/00

[52] U.S. Cl. ..... 439/188

[58] Field of Search ..... 439/188, 394, 439/108, 581; 200/51.09, 51.1, 51.11; 361/799

[56] References Cited

U.S. PATENT DOCUMENTS

| | | | |
|---|---|---|---|
| 4,708,414 | 11/1987 | Lam | 439/394 |
| 4,946,392 | 8/1990 | Kobler et al. | 439/63 |
| 5,062,809 | 11/1991 | Sakamoto et al. | 439/581 |
| 5,083,934 | 1/1992 | Kawaguchi | 439/394 |
| 5,154,632 | 10/1992 | Ijiri | 439/394 |
| 5,267,868 | 12/1993 | Wolff, Jr. | 439/95 |
| 5,304,069 | 4/1994 | Brunker et al. | 439/108 |
| 5,482,475 | 1/1996 | Kawaguchi | 439/394 |
| 6,011,698 | 1/2000 | Buehler | 361/799 |
| 6,019,639 | 2/2000 | Brunker et al. | 439/637 |

FOREIGN PATENT DOCUMENTS

| | | | |
|---|---|---|---|
| 6-251832 | 2/1993 | Japan | H01R 17/04 |

*Primary Examiner*—Neil Abrams
*Assistant Examiner*—Michael Zarroli
*Attorney, Agent, or Firm*—Stephen Z. Weiss

[57] ABSTRACT

A method is provided for tuning the impedance of an electrical switching connector. A pair of switch terminals are provided with operatively engageable contact portions. A pair of ground terminals are juxtaposed alongside the switch terminals. The spacing between at least one of the ground terminals and one of the switch terminals is adjusted to adjust the capacitance therebetween and, thereby, adjust the impedance of the connector. An overlapping area between one of the switch terminals and one of the ground terminals can be adjusted to adjust the capacitance therebetween and, thereby, adjust the impedance of the connector.

13 Claims, 9 Drawing Sheets

IMPEDANCE TUNING IN ELECTRICAL SWITCHING CONNECTOR

FIELD OF THE INVENTION

This invention generally relates to the art of electrical connectors and, particularly, to a method of tuning the characteristic impedance of an electrical switching connector.

BACKGROUND OF THE INVENTION

Radio frequency electrical connectors are used in a wide variety of applications. Such connectors are used in mobile telephones, global positioning systems and the like. Basically, such a connector is a microwave connector.

One example of such connectors is an electrical switching connector used in a transceiver of such devices which requires an antenna, such as a mobile telephone. The transceiver may be normally connected to an internal antenna, and switching terminals are provided for connecting the unit to an external antenna. The switching terminals are normally closed, and a terminal from a coaxial cable opens the normally closed terminals to disconnect the transceiver from the internal antenna and connect the transceiver to the external antenna. With the system being a radio frequency system, ground terminals also are employed in conjunction with the switching terminals.

In designing electrical connectors of the type described above, an ideal connector would be "transparent". In other words, the system would function as if circuitry ran through the interconnection and there would be no affect on the system whatsoever. However, such an ideal connector is impractical or impossible, and continuous efforts are made to develop an electrical connector which has as little affect on the system as possible.

Impedance and inductance control are concerns in designing an ideal connector. In other words, an ideal connector would have little or no affect on the interconnection system regarding these characteristics. This is particularly true in radio frequency connectors as described above. However, since the ideal connector is impractical or impossible, the invention herein is directed to a method for tuning the impedance of an electrical connector, such as an electrical switching connector. It should be understood that the concepts of the invention as disclosed and claimed herein are not limited to radio frequency connectors in that the invention has a wide range of advantageous applications.

SUMMARY OF THE INVENTION

An object, therefore, of the invention is to provide a new and improved method of tuning the impedance of an electrical connector, such as an electrical switching connector.

In the exemplary embodiment of the invention, the method comprises the steps of providing a pair of switch terminals having operatively engageable contact portions. A pair of ground terminals are juxtaposed alongside the switch terminals. The method includes the step of adjusting the spacing between at least one of the ground terminals and one of the switch terminals to adjust the capacitance therebetween and, thereby, adjust the impedance of the connector.

As disclosed herein, the contact portion of the switch terminal is elongated, and the one ground terminal includes an elongated leg generally parallel to the contact portion of the one switch terminal. The adjusting step comprises adjusting the spacing between the elongated contact portion and the elongated leg.

The pair of ground terminals are shown herein in the form of the legs of a generally U-shaped configuration. The ends of the legs are integrally joined by a cross portion of the U-shaped configuration. The invention contemplates tuning the connector by adjusting the spacing between the cross portion and an end of one of the switch terminals. The impedance also can be tuned by varying the size of the cross portion to adjust the impedance of the ground terminals.

The invention also contemplates that at least a portion of the one of the switch terminals overlaps at least a portion of one of the ground terminals. The overlapping area can be adjusted to adjust the capacitance between the terminals and, thereby, adjust the impedance of the connector.

Finally, the invention also contemplates overmolding a dielectric housing about at least portions of the ground terminals and the one switch terminal after the adjusting step(s). Such an overmolding step precisely fixes the terminals in their relative positions of adjustment. Therefore, nothing has to be changed in the size or shape of the connector or the connector housing to provide different connectors with different impedance characteristics which is accomplished simply by adjusting the location of the terminals within the mold in which the housing is overmolded about the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
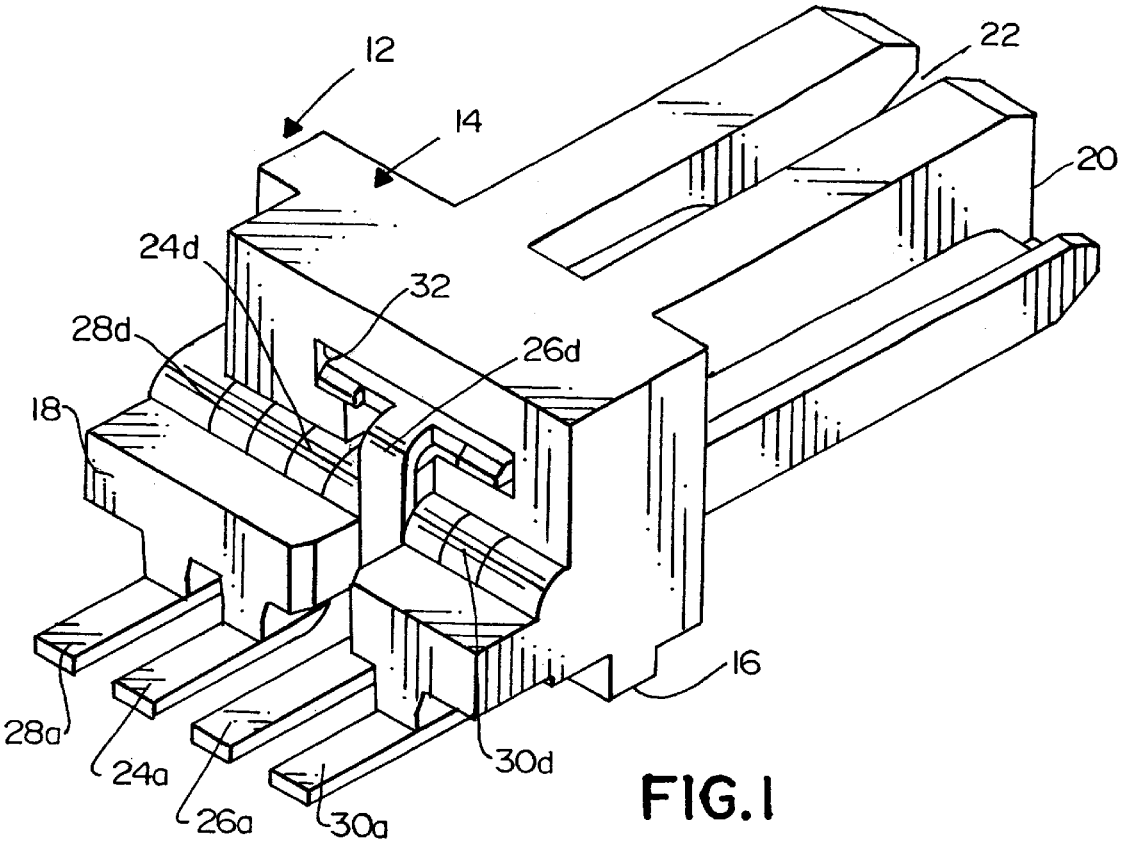
FIG. 1 is a perspective view of the electrical switching connector of the invention, looking toward the rear terminating end thereof.
Figure 2:
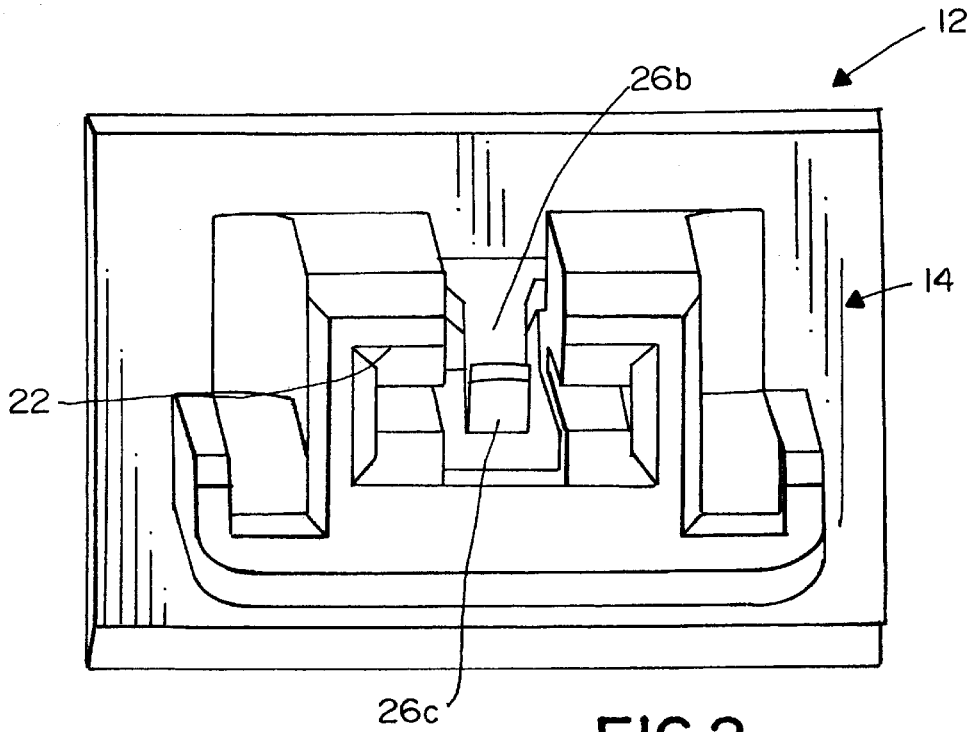
FIG. 2 is a view looking toward the front receptacle end of the connector.

Referring to the drawings in greater detail, and first to FIGS. 1 and 2, the invention is embodied in an electrical switching connector, generally designated 12, which includes a one-piece housing, generally designated 14. The housing is unitarily molded of dielectric material such as plastic or the like. The housing has a bottom mounting surface 16 for mounting the connector on the surface of a printed circuit board (not shown). The housing has a rear terminating end 18 (FIG. 1) and a front receptacle end 20 defining a receptacle 22 (FIG. 2) which receives at least a terminal blade of a complementary mating connector, such as for a coaxial cable coupled to an external antenna.

Figure 3:
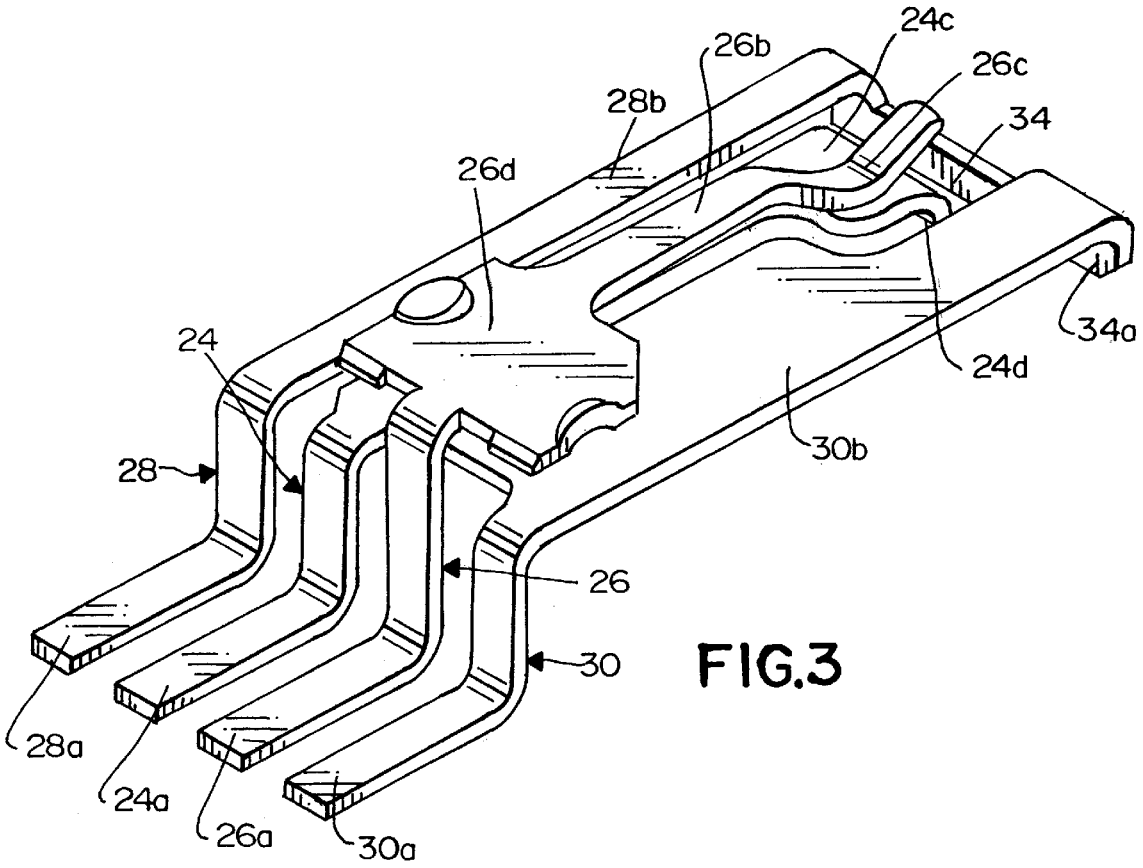
FIG. 3 is a perspective view of the terminals of the connector.
Figure 4:
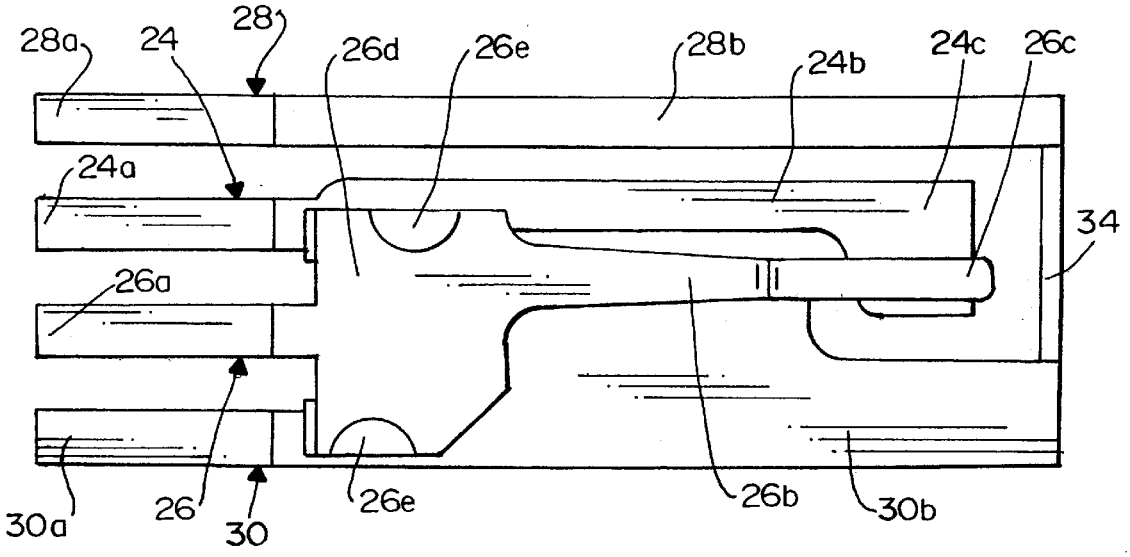
FIG. 4 is a top plan view of the terminals of the connector.

Referring to FIGS. 3 and 4 in conjunction with FIGS. 1 and 2, switching connector 12 includes a first switch terminal, generally designated 24; a second switch terminal, generally designated 26; a first ground terminal, generally designated 28; and a second ground terminal, generally designated 30. All of the terminals are stamped and formed of conductive sheet metal material. All of the terminals 24–30 have coplanar tail portions 24*a*–30*a*, respectively, for connection to appropriate power and ground circuit traces on the printed circuit board, as by soldering.

First switch terminal 24 is the "switched" terminal of the connector and includes an elongated body portion 24*b* extending through housing 14 and including a widened distal end 24*c* defining a contact portion located at receptacle 22 of the housing.

Ground terminals 28 and 30 also have elongated body portions 28*b* and 30*b*, respectively, extending forwardly in the housing on opposite sides of the body portion 24*b* of switch terminal 24. Body portion 30*b* of ground terminal 30 is wider than body portion 28*b* of ground terminal 28 and includes a cut-out area 30*c* for accommodating the widened contact portion 24*c* of switch terminal 24. All of the body portions 24*b*, 28*b* and 30*b* of the respective switch and ground terminals are generally coplanar.

Second switch terminal 26 is a "common" or power terminal of the connector and has an elongated body portion 26*b* which is elevated in a plane above the plane of the body portions of the other terminals. The body portion of the second switch terminal is flexible and has a downwardly projecting, bowed contact portion 26*c* which is normally in engagement with contact portion 24*c* of first switch terminal 24 to provide a normally closed switch for connector 12.

As best seen in FIG. 1, transition portions 24*d*, 28*d* and 30*d* of switch terminal 24 and ground terminals 28 and 30, respectively, along with at least portions of the body portions of those terminals, are overmolded by molded plastic housing 14 to rigidify the terminals and maintain the terminals in precise position and spacing. This can be done easily in a molding die. On the other hand, second switch terminal 26 is inserted into a slot 32 at the rear of the housing so that body portion 26*b* of the terminal is free to flex relative to body portion 24*b* of the first switch terminal 24. As best seen in FIGS. 3 and 4, the second switch terminal has an enlarged plate portion 26*d* which is insertable into slot 32 of the housing. A pair of rounded locking bosses 26*e* provide an interference fit within slot 32 to hold switch terminal 26 in the housing.

As best seen in FIGS. 3 and 4, body portion 28*b* and 30*b* of ground terminals 28 and 30 respectively, form the legs of a generally U-shaped configuration, with the ends of the legs being integrally joined by a cross portion 34 of the U-shaped configuration. Therefore, the unitary U-shaped ground terminal structure surrounds body portion 24*b* and contact portion 24*c* of first switch terminal 24. Finally, as best seen in FIG. 3, in cross portion 34 of the ground terminal structure has a downwardly turned lip 34*a*, and widened contact portion 24*c* of first switch contact 24 also has a downwardly turned lip 24*d*.

Figure 5:
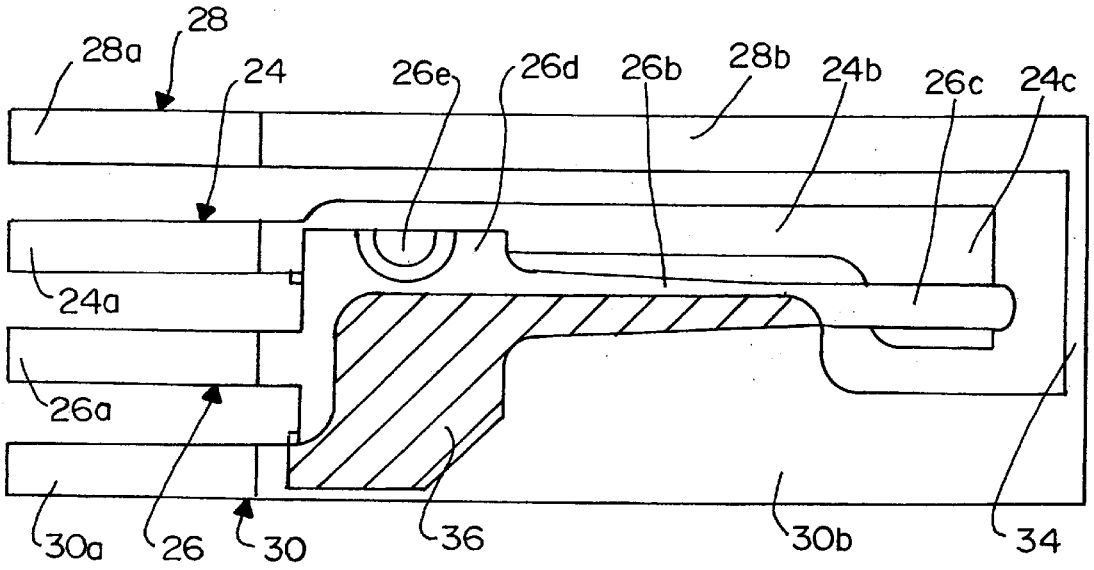
FIG. 5 is a view similar to that of FIG. 4, highlighting the overlapping area between the power terminal and one of the ground terminals.

FIG. 5 is a duplicate of FIG. 4 and simply highlights an area 36 whereat plate portion 26*d* of second switch terminal 26 overlaps body portion 30*b* of ground terminal 30. This overlapping area provides an increase in the capacitor area between those terminals which, in turn, lowers the characteristic impedance of the connector.

Figure 6:
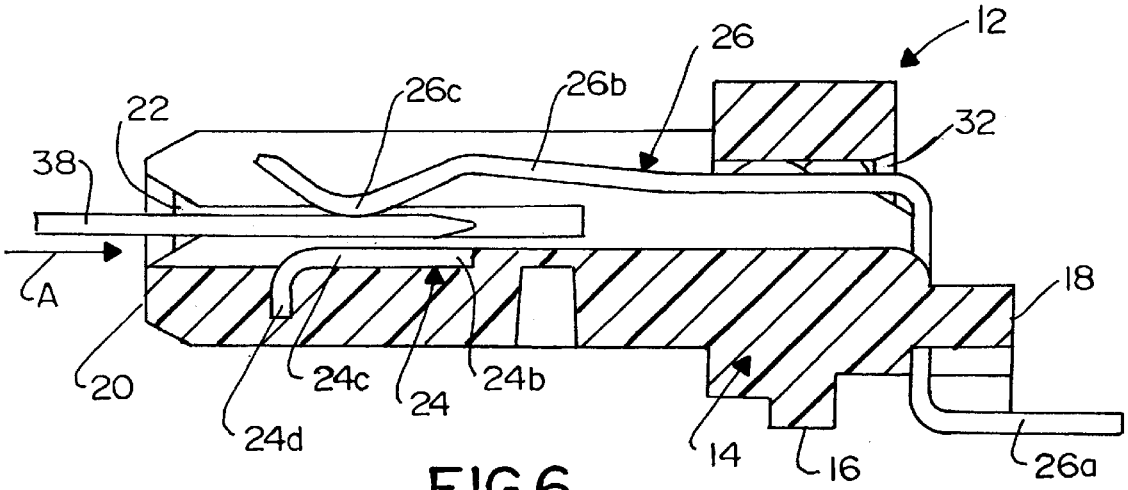
FIG. 6 is a view showing a contact of a complementary mating connector lifting the switched terminal off of the power terminal.
Figure 7:
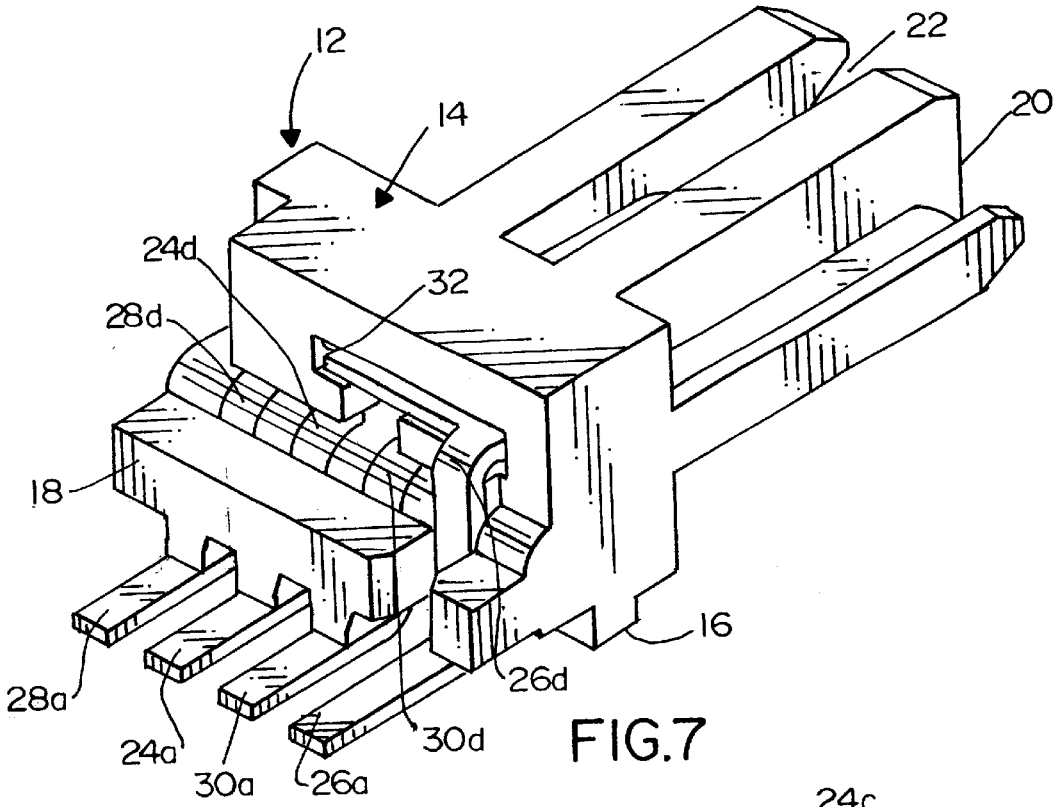
FIG. 7 is a view similar to that of FIG. 1, but showing an alternate configuration for the tail portions of the terminals.
Figure 8:
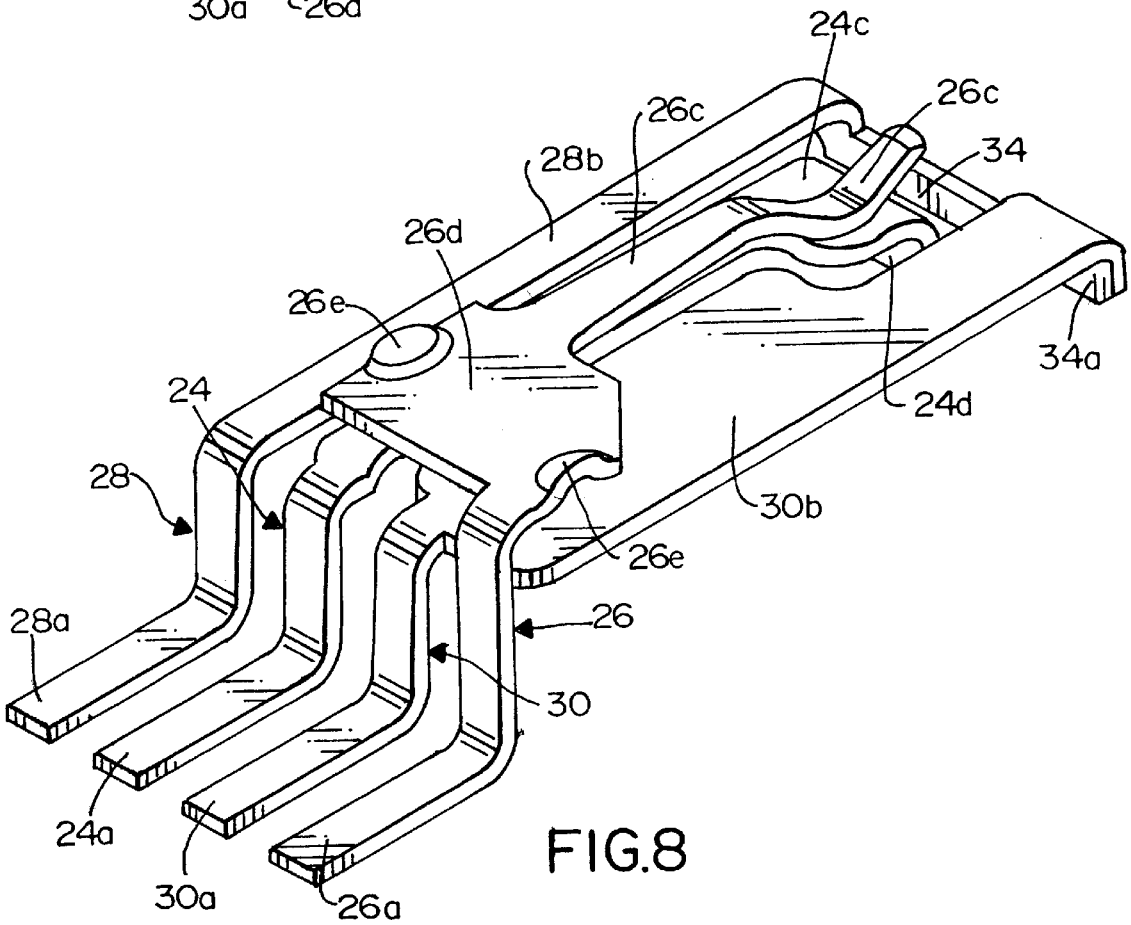
FIG. 8 is a perspective view of the terminals of the connector in FIG. 7.
Figure 9:
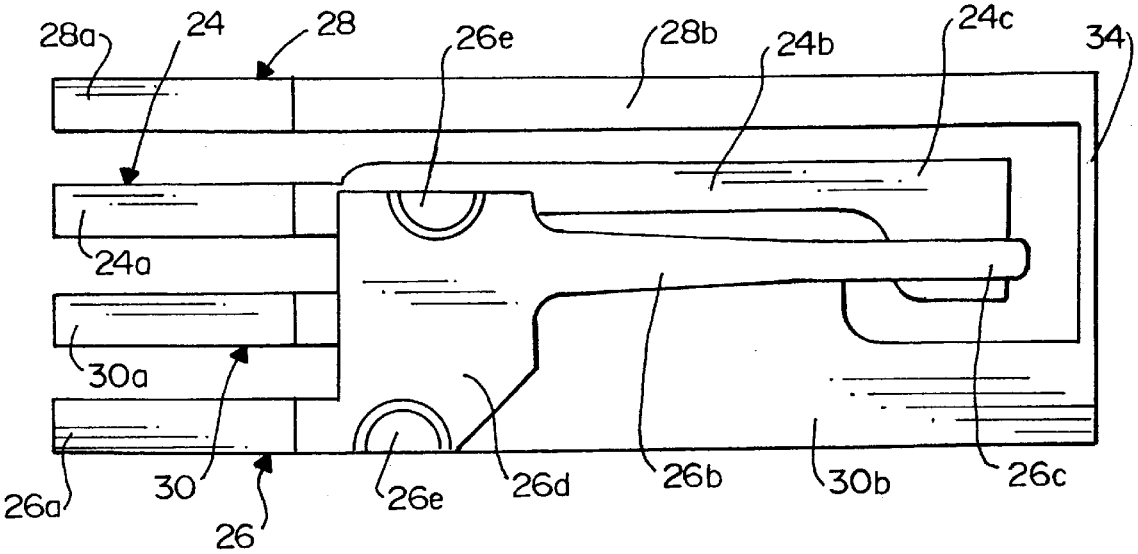
FIG. 9 is a top plan view of the terminals of FIG. 8

FIG. 6 shows a terminal blade 38 of a complementary mating connector inserted into connector 12 and into engagement with contact portion 26*c* of second switch terminal 26. This lifts contact portion 26*c* off of contact portion 24*c* of first switch terminal 24 and, thereby, opens the switch therebetween. In an actual application, switching connector 12 may be a transceiver connector in a mobile telephone unit, for instance. The unit will have an internal antenna which is connected to switch terminal 24 and which is normally coupled in circuit by the normally closed switch terminals 24 and 26. Terminal blade 38 (FIG. 6) may be from a coaxial cable coupled to an external antenna. Therefore, when blade 38 engages contact portion 26*c* of switch terminal 26 to "open" the switch of connector 12, the engagement of blade 38 with second switch terminal 26 now disengages the connector from the internal antenna and couples the connector to the external or outside antenna.

FIGS. 7–10 show an alternate embodiment of the invention and like numerals have been applied in FIGS. 7–10 corresponding to like components described above in relation to FIGS. 1–6. The main difference between the embodiment of FIGS. 7–10 and the embodiment of FIGS. 1–6 is the position of tail portions 26*a* and 30*a* of second switch terminal 26 and second ground terminal 30. Basically, the tails of the terminals define input leads to the connector. These different embodiments show that the input leads can be easily interchanged in position to allow different "hook-ups" on the printed circuit board. This is difficult if not impossible with most prior art radio frequency receptacles because of the manner in which the shields of those receptacles are designed.

Figure 10:
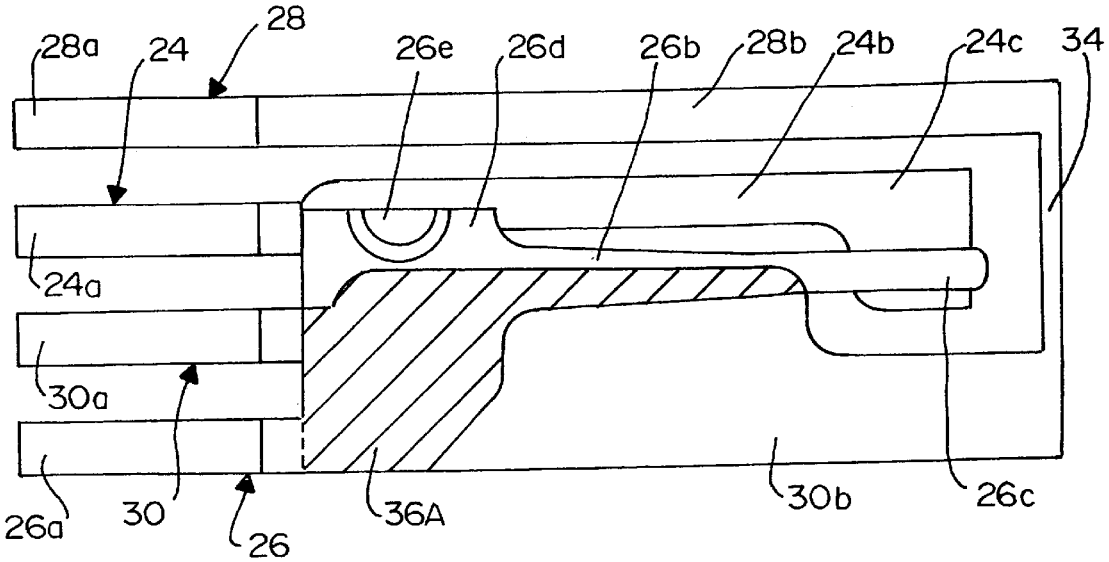
FIG. 10 is a view similar to that of FIG. 9, highlighting the overlapping area between the power terminal and one of the ground terminals.

FIG. 10 also shows a difference between the embodiment of FIGS. 7–10 and the embodiment of FIGS. 1–5. Specifically, an overlapping area 36A between second switch terminal 26 and second ground terminal 30 as highlighted in FIG. 10 is slightly larger than the overlapping area 36 in FIG. 5.

Figure 11A:
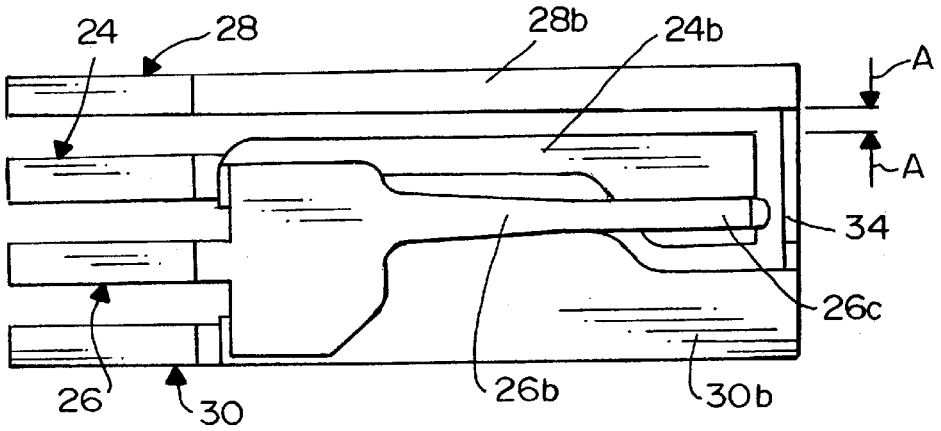
FIGS. 11A and 11B show a method of tuning the characteristic impedance of the connector.
Figure 11B:
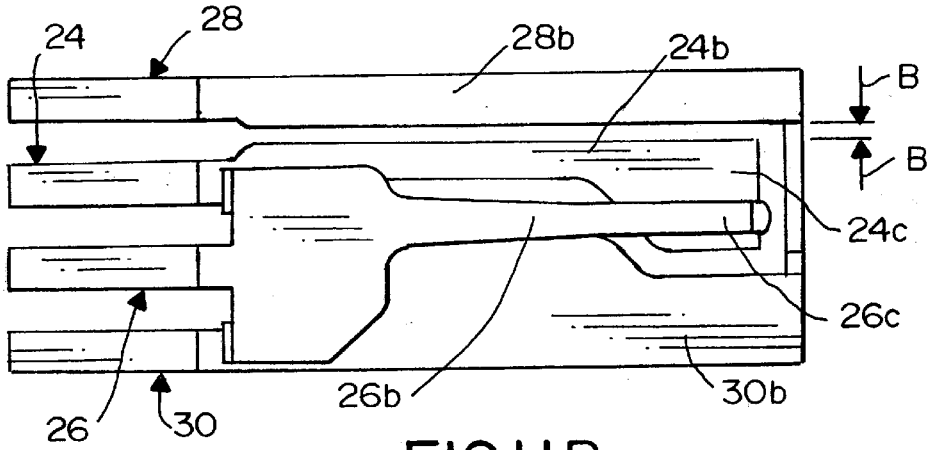

FIGS. 11A and 11B show one method of tuning the characteristic impedance of electrical switching connector 14. Specifically, it can be seen that body portion 28*b* of ground terminal 28 extends alongside of and parallel to elongated body portion 24*b* of first switch terminal 24. It can be seen that the spacing between these elongated body portions of the two terminals is larger in FIG. 11A as indicated by arrows "A" than the spacing in FIG. 11B as indicated by arrows "B". The larger spacing "A" will result in a higher impedance and the smaller spacing "B" will result in a lower impedance. Therefore, the characteristic impedance of the connector can be tuned by changing this spacing between the elongated body portions of these two terminals.

Figure 12A:
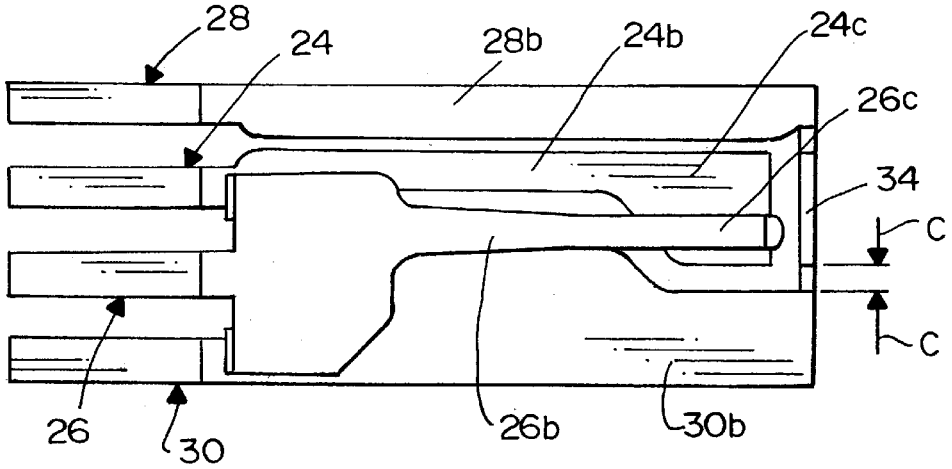
FIGS. 12A and 12B show a second method of tuning the characteristic impedance of the connector.
Figure 12B:
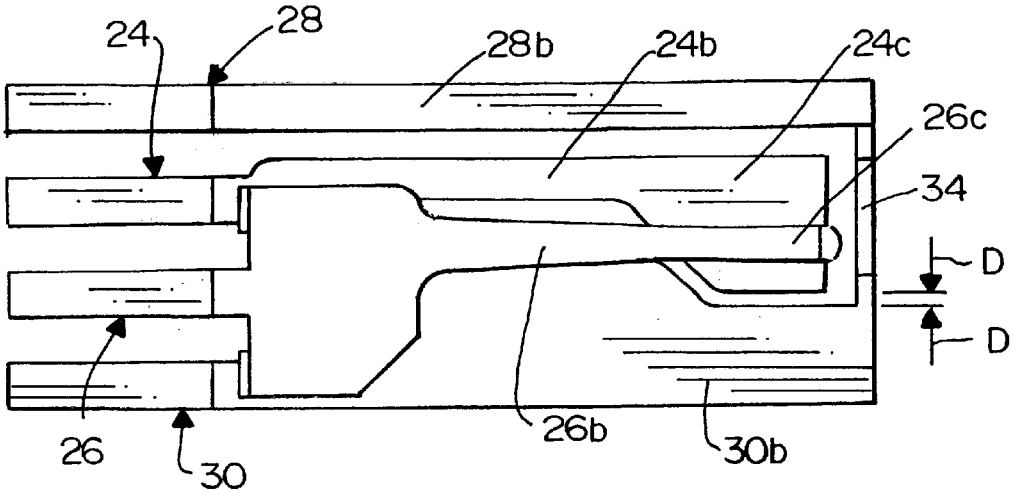

FIGS. 12A and 12B show another method of tuning the characteristic impedance of connector 14. Specifically, it can be seen that a given spacing "C" between contact portion 24*c* of switch terminal 24 and the end of ground terminal 30 is greater than the spacing "D" in that area between the terminals in FIG. 12B. The larger spacing "C" in FIG. 12A will create a higher impedance than the smaller spacing "D" in FIG. 12B. Therefore, the characteristic impedance of the connector can be tuned by adjusting this spacing between switch terminal 24 and ground terminal 30.

Figure 13A:
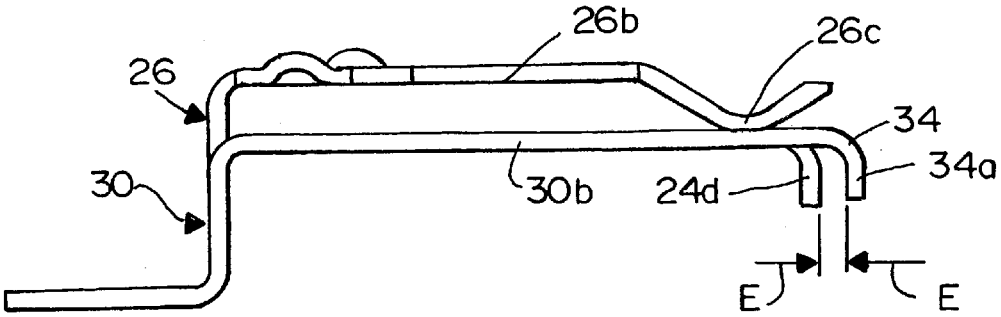
FIGS. 13A and 13B show a third method of tuning the characteristic impedance of the connector.
Figure 13B:
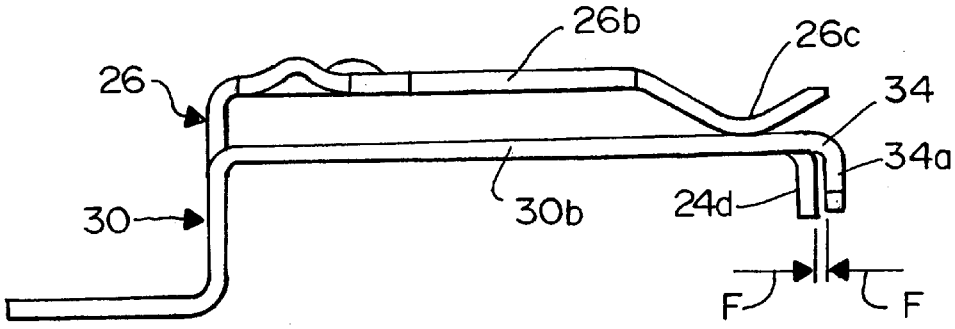

FIGS. 13A and 13B show a third method of tuning the characteristic impedance of connector 14. Specifically, FIG. 13A shows a given spacing "E" between the downturned lip 34*a* of cross portion 34 of the U-shaped ground terminal configuration and the downturned lip 24*d* of the contact portion of switch terminal 24 (FIG. 3). FIG. 13B shows a smaller spacing "F" between these downturned lips. Larger spacing "E" in FIG. 13A will create a higher impedance than smaller spacing "F" between the downturned lips in FIG. 13B. Therefore, the characteristic impedance of the connector can be tuned by adjusting the spacing between downturned lips 24*d* and 34*a* of switch terminal 24 and the ground terminals, respectively.

Figure 14A:
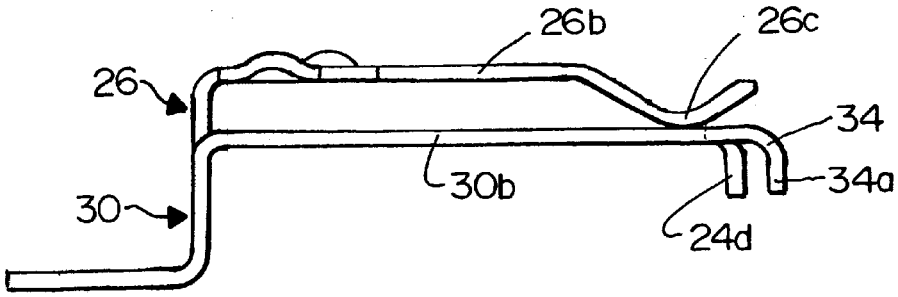
FIGS. 14A–14C show a method of adjusting the inductance in the U-shaped ground terminal structure.
Figure 14B:
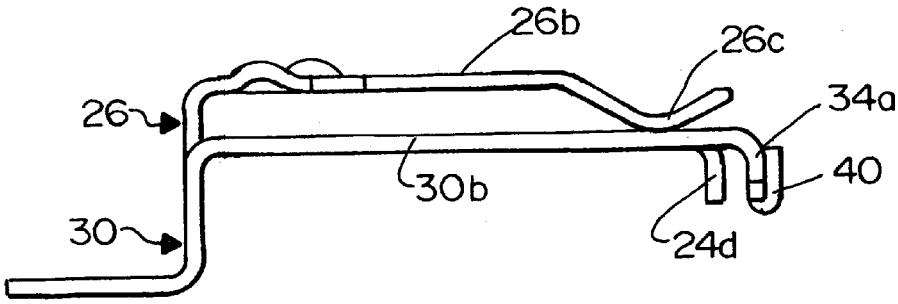
Figure 14C:
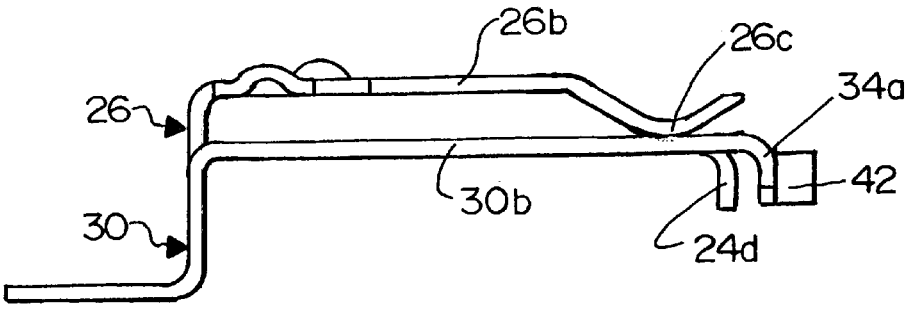

FIGS. 14A–14C show a method of varying the size (i.e. volume) of the downturned lip 34*a* of cross portion 34 of the U-shaped ground terminal configuration. Specifically, FIG. 14A shows the size of the stamped and formed terminal as described above in relation to FIG. 3, for instance. FIG. 14B shows the downturned lip folded back upwardly, as at 40, to essentially double the thickness thereof. This increases the size/volume of the cross portion of the U-shaped ground terminal configuration and lowers the inductance thereof. FIG. 14C shows an alternate method wherein, rather than folding the downturned lip back upwardly, an additional strip 42 of conductive material is adhered to the outside of the downturned lip. Like the upturned lip 40 in FIG. 14B, the additional conductive strip 42 in FIG. 14C will lower the inductance in the cross portion of the U-shaped ground terminal configuration.

Figure 15A:
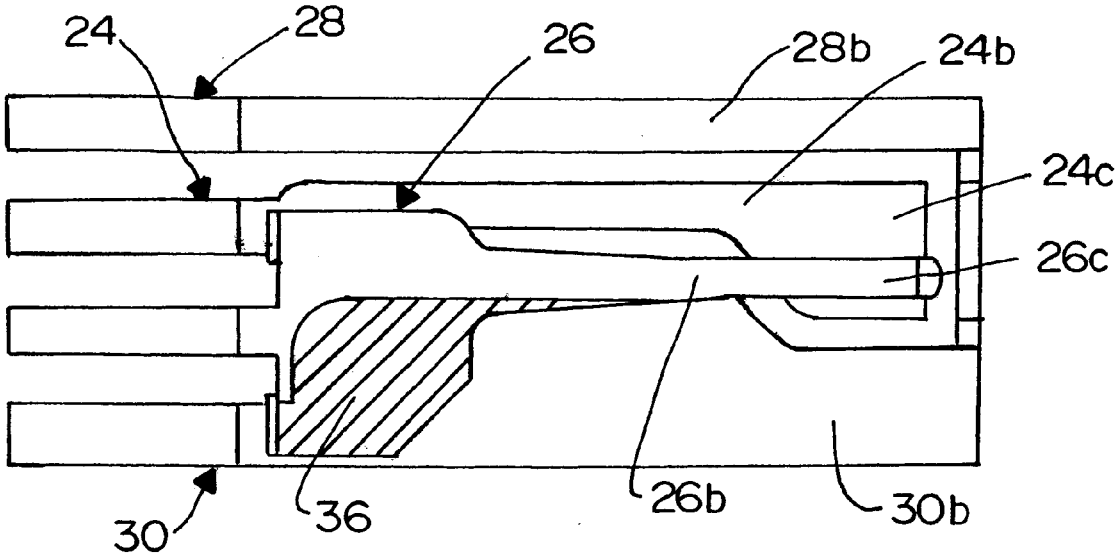
FIGS. 15A and 15B show a method of varying overlapping areas between the second switch terminal and one of the ground terminals for tuning the characteristic impedance of the connector.
Figure 15B:
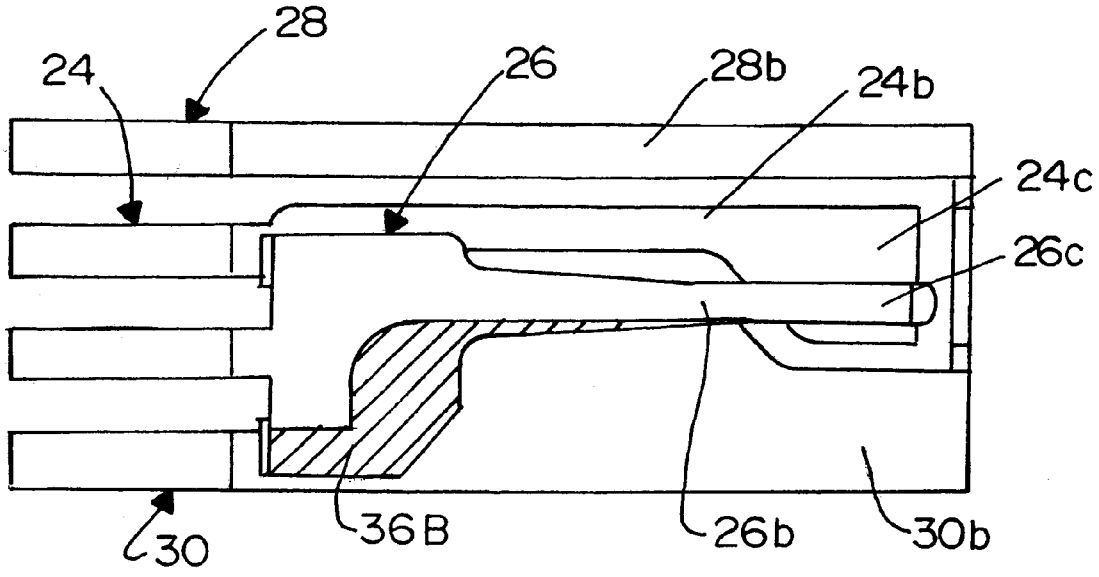

Finally, FIGS. 15A and 15B show a further method of tuning the impedance of connector 14. FIGS. 15A and 15B should be viewed in conjunction with FIGS. 5 and 10. In fact, FIG. 15A shows overlapped area 36 corresponding to the overlapped area 36 in FIG. 5, between second switch terminal 26 and second ground terminal 30. As stated above, overlapping area 36A in FIG. 10 between the second switch terminal and the second ground terminal is slightly larger than the overlapping area 36 in FIGS. 5 and 15A. This will result in a lower characteristic impedance because overlapping area 36A is larger than overlapping area 36. Conversely, FIG. 15B shows an overlapping area 36B which is smaller than overlapping area 36 in FIGS. 5 and 15A. This overlapping area 36B will result in a higher impedance because the "capacitor plate" area between the respective terminals is smaller.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of tuning impedance of an electrical switching connector, comprising the steps of:

providing a pair of switch terminals having operatively engageable contact portions;

providing a pair of ground terminals juxtaposed alongside a given space from the switch terminals;

adjusting the spacing between at least one of the ground terminals and one of the switch terminals to adjust the capacitance therebetween and, thereby, adjust the impedance of the connector; and at least a portion of one of said switch terminals overlapping at least a portion of one of said ground terminals, and including the step of adjusting the overlapping area to adjust the capacitance between the terminals and, thereby, to further adjust the impedance of the connector.

2. The method of claim 1 wherein the contact portion of said one switch terminal is elongated, and said at least one ground terminal includes an elongated leg generally parallel to the contact portion of the one switch terminal, and said adjusting step comprises adjusting the spacing between the elongated contact portion and the elongated leg.

3. The method of claim 1 wherein said pair of ground terminals form legs of a generally U-shaped ground terminal configuration with ends of the legs being integrally joined by a cross portion of the U-shaped ground terminal configuration having a given size, and said adjusting step comprises adjusting the spacing between the cross portion and an end of one of the switch terminals.

4. The method of claim 3, including the step of varying the size of said cross portion to adjust the inductance of the ground terminal configuration.

5. The method of claim 1, including the step of overmolding a dielectric housing about at least portions of said at least one ground terminal and said one switch terminal after said adjusting step.

6. A method of tuning impedance of an electrical switching connector, comprising the steps of:

providing a pair of switch terminals having operatively engageable contact portions;

providing a pair of ground terminals juxtaposed alongside a given space from the switch terminals, the ground terminals forming legs of a generally U-shaped ground terminal configuration with ends of the legs being integrally joined by a cross portion of the U-shaped ground terminal configuration having a given size;

adjusting the space between the cross portion of the U-shaped ground terminal configuration having a given size and an end of one of the switch terminals; and at least a portion of one of said switch terminals overlapping at least a portion of one of said ground terminals, and including the step of adjusting the overlapping area to adjust the capacitance between the terminals and, thereby, adjust the impedance of the connector.

7. The method of claim 6, including the step of varying the size of said cross portion to adjust the inductance of the ground terminal configuration.

8. The method of claim 6, including the step of overmolding a dielectric housing about at least portions of said U-shaped ground terminal configuration and said one switch terminal after said adjusting step.

9. A method of tuning impedance of an electrical switching connector, comprising the steps of:

providing a pair of switch terminals having operatively engageable contact portions;

providing a pair of ground terminals juxtaposed alongside the switch terminals;

overlapping at least a portion of one of the switch terminals and at least a portion of one the ground terminals; and adjusting the overlapping area between said overlapped terminals to adjust the capacitance between the terminals and, thereby adjust the impedance of the connector.

10. The method of claim 9, including the step of overmolding a dielectric housing about at least portions of at least said one ground terminal after said adjusting step.

11. The method of claim 10 wherein said pair of ground terminals form the legs of a generally U-shaped ground terminal configuration with ends of the legs being integrally joined by a cross portion of the U-shaped ground terminal configuration, and including the step of varying the size of said cross portion to adjust the inductance of the ground terminal configuration.

12. A method of tuning impedance of an electrical switching connector, comprising the steps of:

providing a pair of switch terminals having operatively engageable contact portions;

providing a pair of ground terminals juxtaposed alongside the switch terminals, the ground terminals forming legs of a generally U-shaped ground terminal configuration with ends of the legs being integrally joined by a cross portion of the U-shaped ground terminal configuration having a given size;

varying the size of said cross portion to adjust the inductance of the ground terminal configuration; and at least a portion of one of said switch terminals overlapping at least a portion of one of said ground terminals, and including the step of adjusting the overlapping area to adjust the capacitance between the terminals and, thereby, adjust the impedance of the connector.

13. The method of claim 12, including the step of overmolding a dielectric housing about at least portions of at least one ground terminal and at least one switch terminal.

* * * * *